United States Patent [19]

Szymaszek

[11] Patent Number: 4,610,613

[45] Date of Patent: Sep. 9, 1986

[54] CONTROL MEANS FOR GAS COMPRESSOR HAVING DUAL SLIDE VALVES

[75] Inventor: Paul G. Szymaszek, Waukesha, Wis.

[73] Assignee: Vilter Manufacturing Corporation, Milwaukee, Wis.

[21] Appl. No.: 740,817

[22] Filed: Jun. 3, 1985

[51] Int. Cl.[4] ..... F04C 18/16; F04C 18/20

[52] U.S. Cl. ..... 418/195; 418/201; 417/310; 417/440

[58] Field of Search ..... 418/195, 201–203; 417/310, 440, 283

[56] References Cited

U.S. PATENT DOCUMENTS

| | | | |
|---|---|---|---|
| 3,151,806 | 10/1964 | Whitfield | 418/201 |
| 3,756,753 | 9/1973 | Persson | 418/201 |
| 3,936,239 | 2/1976 | Shaw | 418/201 |
| 4,261,691 | 4/1981 | Zimmern | 417/440 |
| 4,457,861 | 6/1984 | Garland | 418/201 |

FOREIGN PATENT DOCUMENTS

| | | | |
|---|---|---|---|
| 32967 | 3/1980 | Japan | 417/440 |
| 2077951 | 12/1981 | United Kingdom | 417/310 |
| 2119446 | 11/1983 | United Kingdom | 418/201 |

*Primary Examiner*—Leonard E. Smith
*Assistant Examiner*—Jane E. Obee
*Attorney, Agent, or Firm*—James E. Nilles; Thomas F. Kirby

[57] ABSTRACT

A rotary screw gas compressor for a refrigeration system comprises a motor-driven single main rotor having helical grooves and mounted for rotation in a rotor bore in the compressor housing and a pair of star-shaped gate rotors rotatably mounted in the housing and engageable with the helical grooves to define a plurality of compression chambers. A suction slide valve member is slidably positionable (between full load and unload positions) to control where low pressure uncompressed refrigerant gas from a suction port is admitted to the compression chambers to thereby function as a suction bypass to control compressor capacity. A discharge slide valve member is slidably positionable (between minimum and adjusted volume ratio positions) to control where high pressure compressed refrigerant gas is expelled from the compression chambers to a discharge port to thereby control the volume ratio and thereby the input power to the compressor. Both slide valve members are disposed in side-by-side sliding relationship in a common recess in the compressor housing which extends alongside and communicates with the rotor bore and each has a face which is complementary to and confronts the main rotor surface in sliding sealed relationship. The slide valve members are independently movable by separate piston-cylinder type hydraulic actuators. A control system responsive to compressor capacity and volume ratio operates the actuators to position the slide valve members to cause the compressor to operate at a predetermined capacity and minimum power input. The control system includes sensing devices to detect the position of the slide valve members.

7 Claims, 9 Drawing Figures

"GAS PRESSURE-VOLUME DIAGRAM"

CONTROL MEANS FOR GAS COMPRESSOR HAVING DUAL SLIDE VALVES

BACKGROUND OF THE INVENTION

1. Field of Use

This invention relates generally to rotary screw gas compressors used in refrigeration systems and to adjustably positionable slide valves used in such compressor to control their operation.

In particular, it relates to dual slide valves for a single rotary screw type gas compressor or the like and to improved control means for independently positioning the dual slide valves to thereby regulate both compressor capacity and compressor power input.

2. Description of the Prior Art

Rotary screw gas compressors used in refrigeration systems to compress refrigerant gas are available in two types, namely, those comprising two intermeshed helically-grooved main rotors or those comprising a single helically-grooved rotor, the grooves of which one engaged with one or more star-shaped or bladed gate rotors. In the latter type (called a "single screw" compressor) the main rotor is mounted for rotation in a bore in a compressor housing and is driven by an electric motor. The gate rotors are also mounted in the compressor housing and engage the main rotor. In such a single screw rotary compressor, each rotor groove, when engaged by a gate rotor blade, serves as a compression chamber in which uncompressed low-pressure gas received from a suction port in the housing is compressed and discharged as compressed high pressure gas to a discharge port in the housing. The gas pressure at the discharge port tends to vary substantially in response to variations in ambient temperatures resulting from seasonal or environmental temperature changes. If not corrected, the gas may be overcompressed in some situations and this results in extra work for the compressor and undesirable waste of electrical input power needed for operating the compressor. Accordingly, it is the practice to employ a slide valve which is movably positionable to adjust the location at which the discharge port opens; the preferred location being that at which internal gas pressure in the compression chambers on the rotor equals the condensing pressure in the refrigeration system in which the compressor is employed. Typically, the slide valve is mounted for axial movement in a recess adjacent and in communication with the rotor bore. The slide valve has a face which is complementary to and confronts the rotor surface in sliding sealed relationship. Means are employed to determine the most efficient position for the volume ratio slide valve and may take the form of means to sense these two pressure conditions, or to calculate positions, and to shift the slide valve axially in the proper direction for the proper distance until the equalization location is reached. Thus, if the discharge port on the slide is moved toward the discharge end of the rotor and compressor, the gas is trapped in the rotor grooves for a longer period of time and its volume is reduced as its pressure is increased i.e., the volume ratio is increased. On the other hand, if the discharge port on the slide valve is moved in the opposite direction, the volume ratio is lowered i.e., the internal cylinder pressure at the point of discharge is lowered, thereby causing the compressor volume ratio to decrease.

It is known to vary the capacity of dual or single rotor compressors by reducing or increasing the amount of gas trapped in each compression chamber by employing a slide valve to recirculate the gas back to the inlet. The following U.S. patents owned by the assignee of the present application illustrate the use of slide valves and controls therefor in dual rotor compressors to control the location at which gas is introduced to the compression chambers: 4,080,110; 4,005,949; 3,924,972; 3,869,227.

The hereinafter identified United Kingdom patents pertain to and disclose various features of a rotary screw gas compressor which employs a single helically grooved main rotor and star-shaped gate rotors engaged with the main rotor: 1,046,465; 1,288,603; 1,242,192; 1,345,946; 1,390,085; 1,388,537; 1,413,426; 1,407,135. A commercial embodiment of such a single screw rotary compressor is available from Hall-Thermotank Products Limited, Hythe Street, Dartford, Kent DA 1 1BU, England and is disclosed in that company's brochure entitled "The Hall Screw". The aforesaid commercial embodiment has slide valve members associated with the main rotor which are movable to regulate compressor capacity, but the built-in volume ratio needs to be maintained at full load and as capacity is reduced in order to achieve the most efficient operation.

U.S. Pat. No. 4,388,040 discloses a dual rotor compressor wherein a single slide valve and control means therefor operates to by-pass the suction port to control compressor capacity and the same slide valve has an extreme position wherein it is at compressor maximum load position wherein the discharge port is slightly enlarged.

U.S. Pat. Nos. 3,088,658 and 3,088,659 disclose a dual rotor compressor having two independently adjustable slide valves located on opposite sides of the dual rotors to regulate either the inbuilt pressure ratio or the capacity or both.

U.S. Pat. No. 3,869,227 owned by the assignee of the present application discloses a rotary screw type gas compressor employing two intermeshed helical main rotors, a single slide valve member associated with the two main rotors and movable to adjust the size of the opening of the high pressure gas discharge port to thereby regulate compressor capacity, and piston-cylinder type pneumatic activators to adjustably position the slide valve member.

SUMMARY OF THE PRESENT INVENTION

This invention relates to an improved rotary screw type gas compressor such as it used in a refrigeration system and to improved slide valve means employed therein to control compressor operation. In particular, it relates to improved slide valve means comprising dual slide valve members for regulating both compressor capacity and compressor power input and to improved control means for independently positioning the dual slide valve members.

The invention is especially well-suited for application of a rotary screw type gas compressor which comprises a housing or casing having a cylindrical bore therein, a motor-driven helically grooved single main rotor mounted for rotation in the bore, and a pair of star-shaped gate rotors rotatably mounted in the housing and engageable with the grooves in the main rotor to define a plurality of compression chambers, one chamber at each groove. A suction port admits low pressure uncompressed refrigerant gas to the compression chambers. A discharge port releases high pressure compressed refrigerant gas from the compression chambers.

In accordance with the invention, the dual slide valve members comprise a suction slide valve member which is slidably positionable to control the extent to which the suction port is open to thereby function as a suction by-pass to control compressor capacity. The dual slide valve members further comprise a discharge slide valve member which is independently slidably positionable to control the position at which the discharge port is open to thereby control the volume ratio and thereby the input power to the compressor. Both slide valve members are disposed in side-by-side sliding relationship in a recess in the housing which extends alongside and is in communication with the cylindrical bore and each slide valve member has a face which is complementary to and confronts the main rotor surface in sliding sealed relationship. The slide valve members are movable independently of each other by improved control means which includes separate piston-cylinder type pneumatic actuators and sensing means therefor.

In accordance with the invention, the control means or system is responsive to the capacity of the compressor and to the volume ratio and operates the actuators to appropriately position the slide valve members and thereby enable the compressor to operate at a predetermined capacity and a predetermined volume ratio. The control system includes a rheostat or variable differential transformer to detect the position of the suction slide valve member and similar sensing means are used to detect the location of the discharge slide valve member.

In the embodiment of the invention disclosed herein, two dual slide valve assemblies are employed with a single main rotor. These two assemblies are located on opposite sides of the rotor, being spaces 180° apart from each other, and each dual slide valve assembly comprises a suction slide valve member and a discharge slide valve member.

The invention offers several advantages over the prior art. For example, it is possible to adjust volume ratio and thereby adjust power input and compressor capacity in a single screw, thereby insuring that the compressor performs at maximum efficiency. The dual slide valves are conveniently mounted in a single recess in the compressor having thereby simplifying compressor housing design at reducing costs. The control means employ improved means for sensing suction slide valve position and, in one embodiment, employ improved pressure-responsive sensing means to adjust the position of the discharge slide valve member. Other objects and advantages of the invention will hereinafter appear.

DRAWINGS

Figure 1:
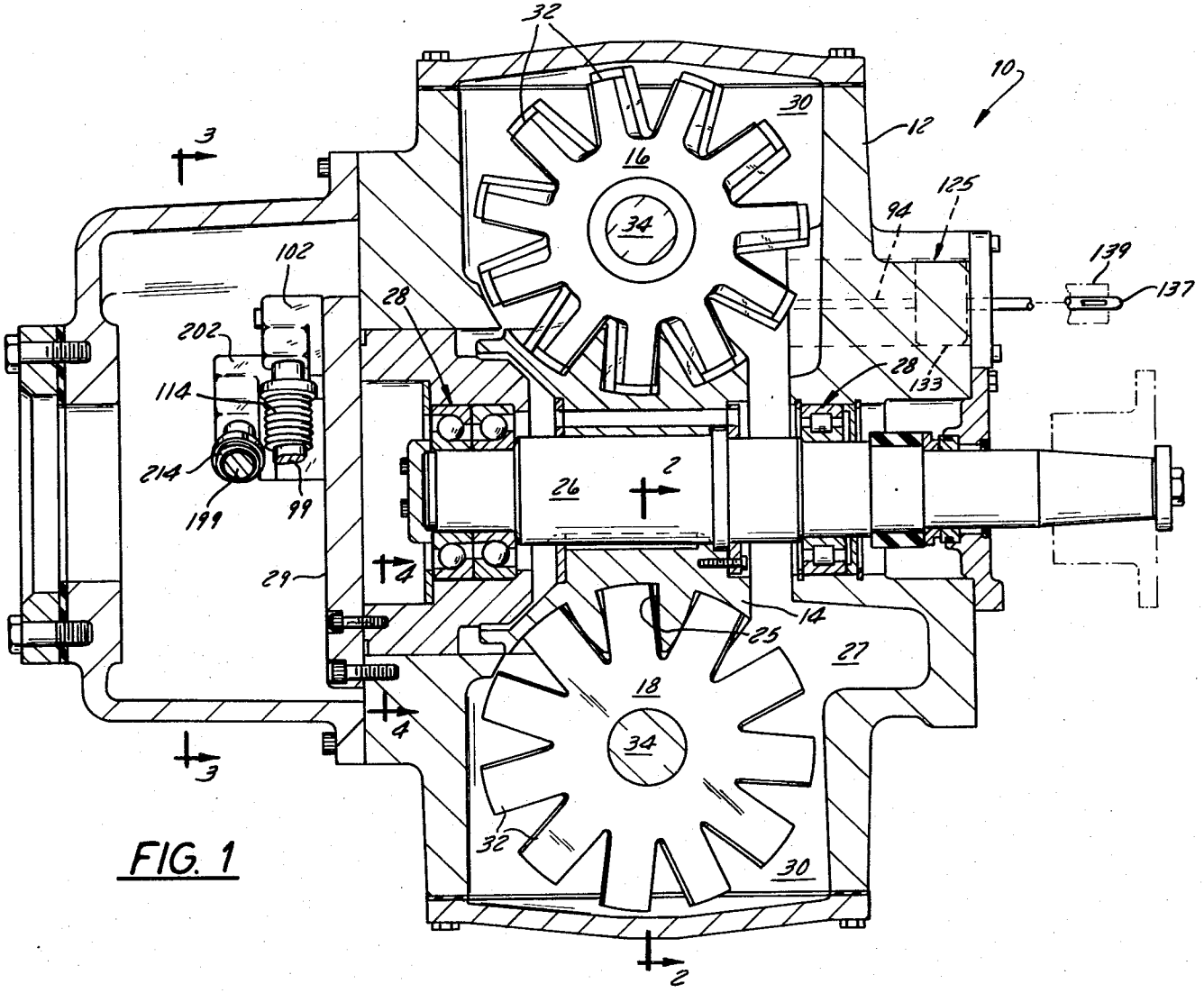
FIG. 1 is a top view, partly in cross-section and with portions broken away, of a rotary gas compressor employing a single screw rotor, a pair of star rotors and having dual slide valves (not visible) in accordance with the present invention.
Figure 2:
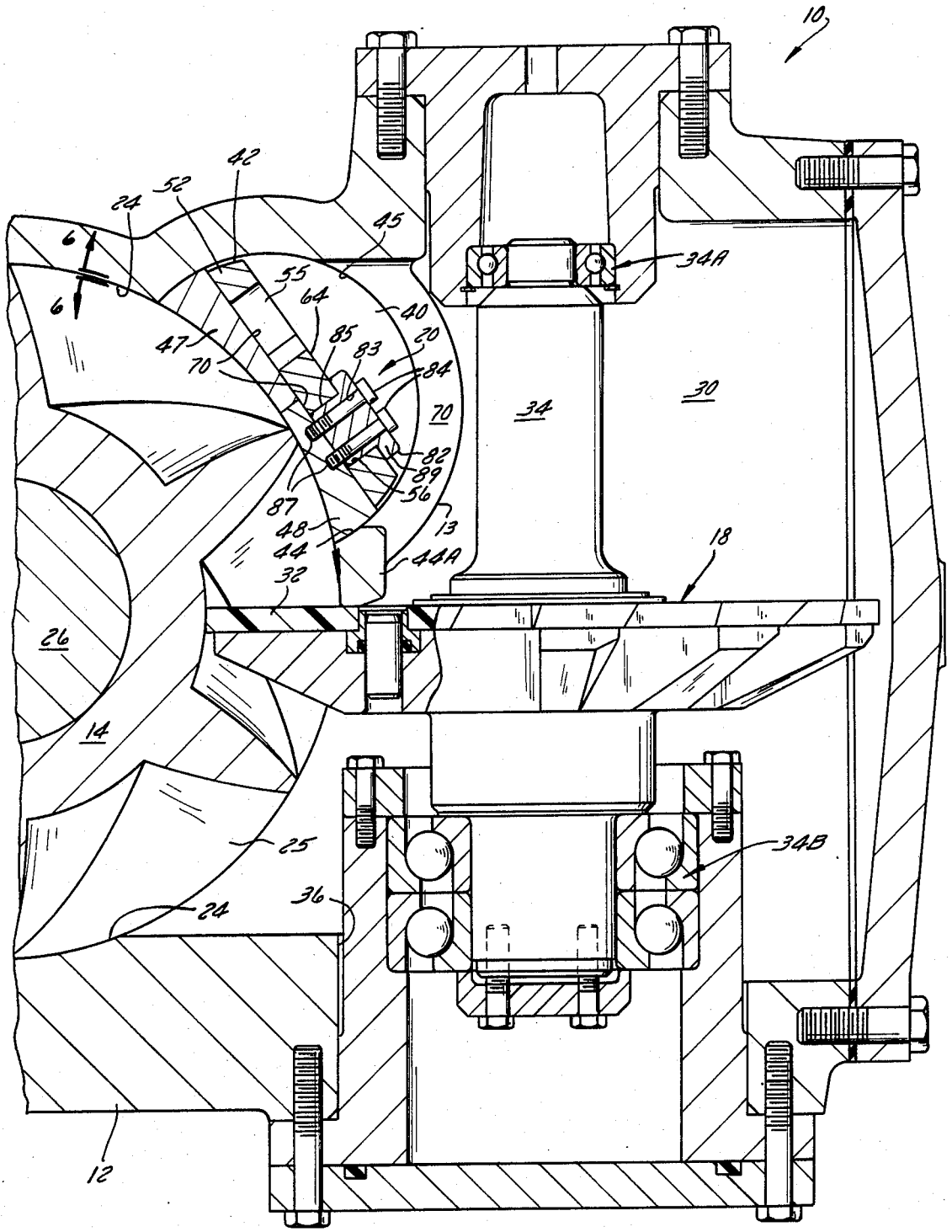
FIG. 2 is an enlarged cross-section view taken on line 2—2 of FIG. 1 and showing one set of dual slide valves in cross-section.
Figure 5:
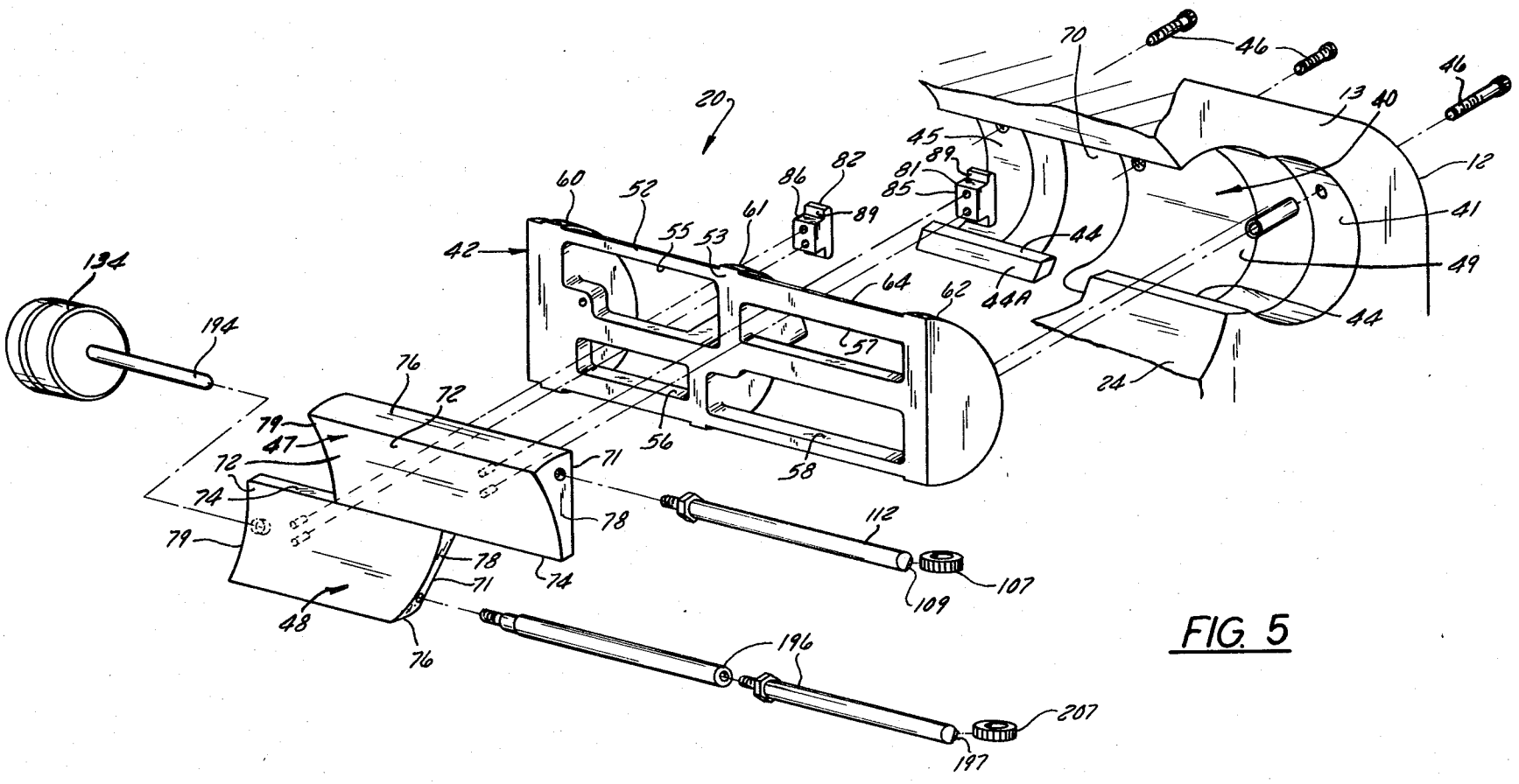
Figure 6:
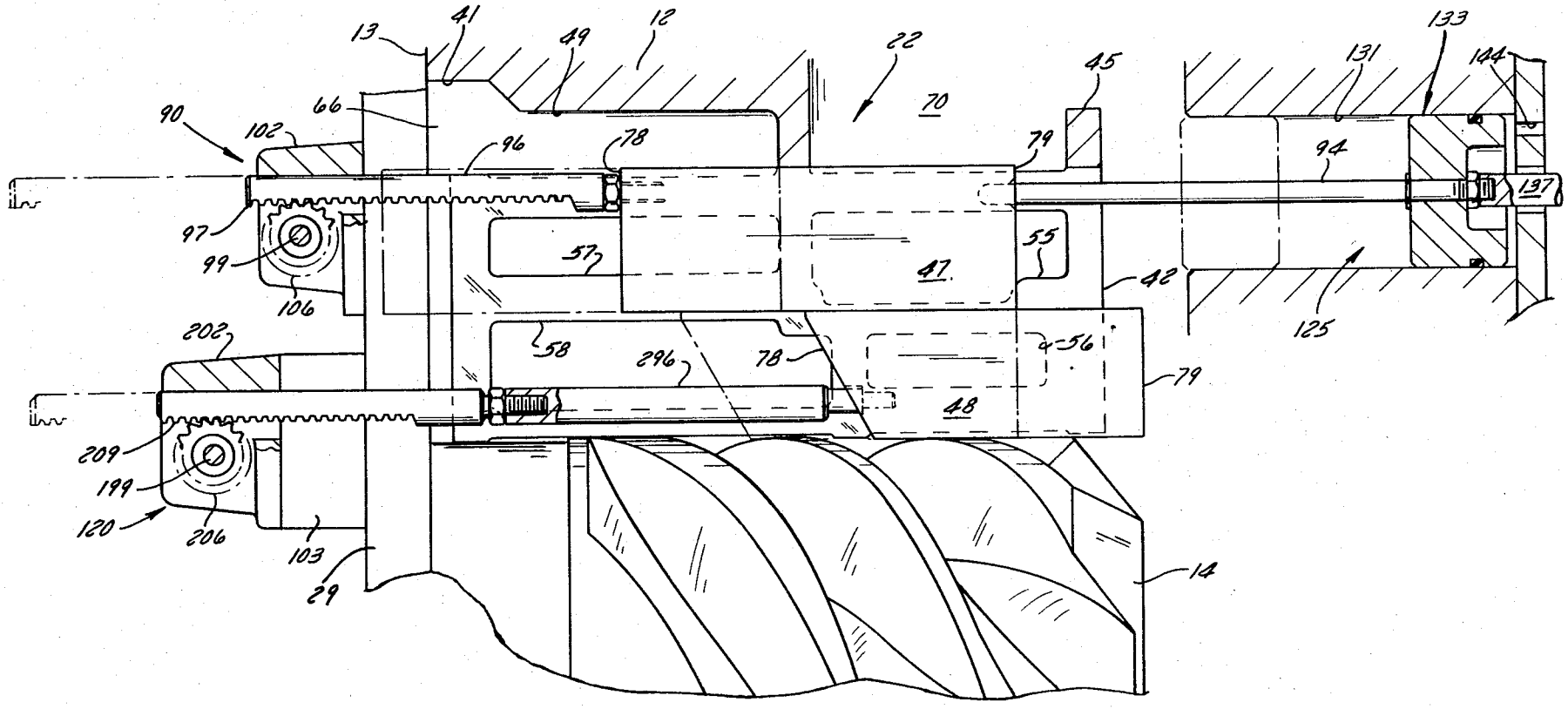
Figure 7:
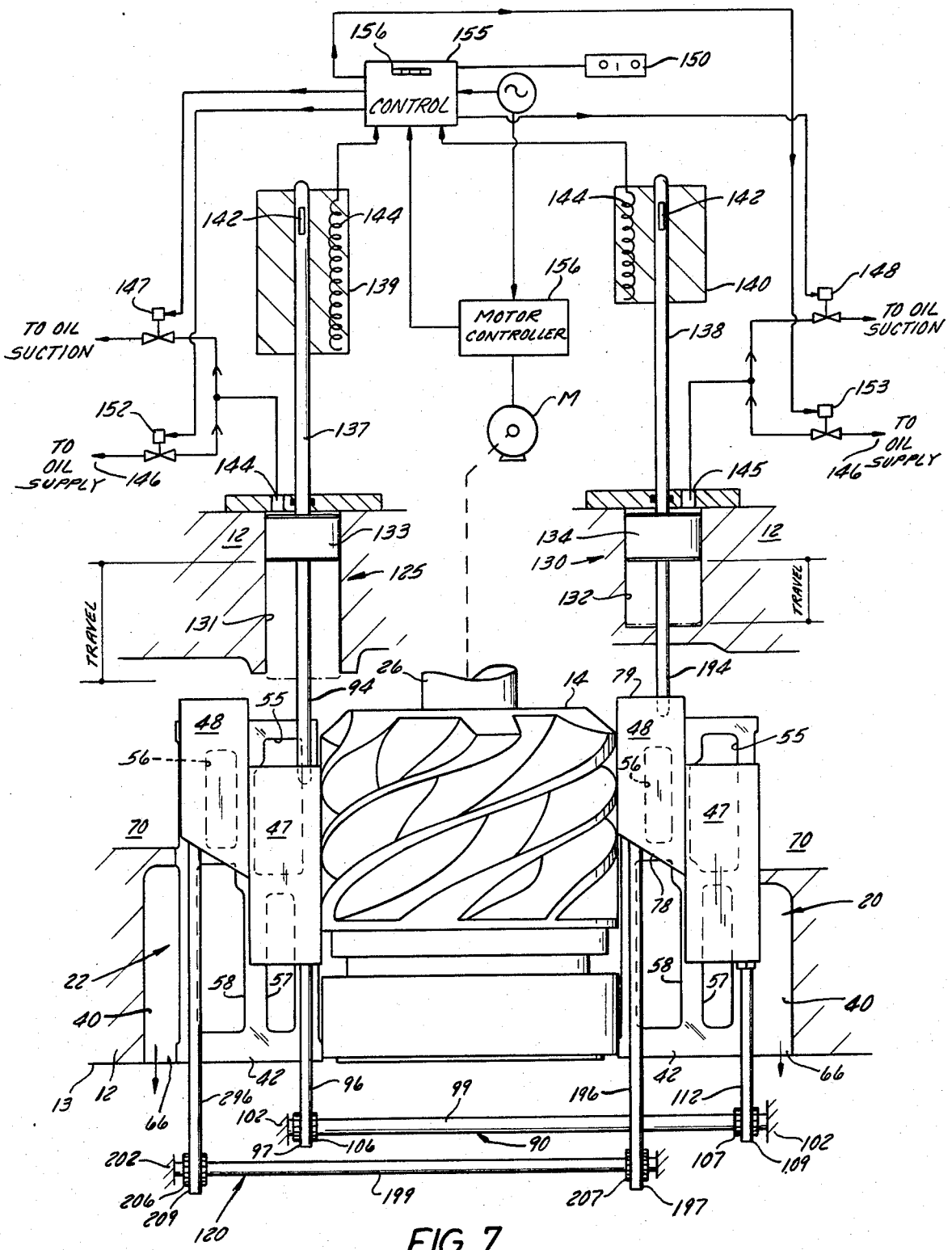
Figure 9:
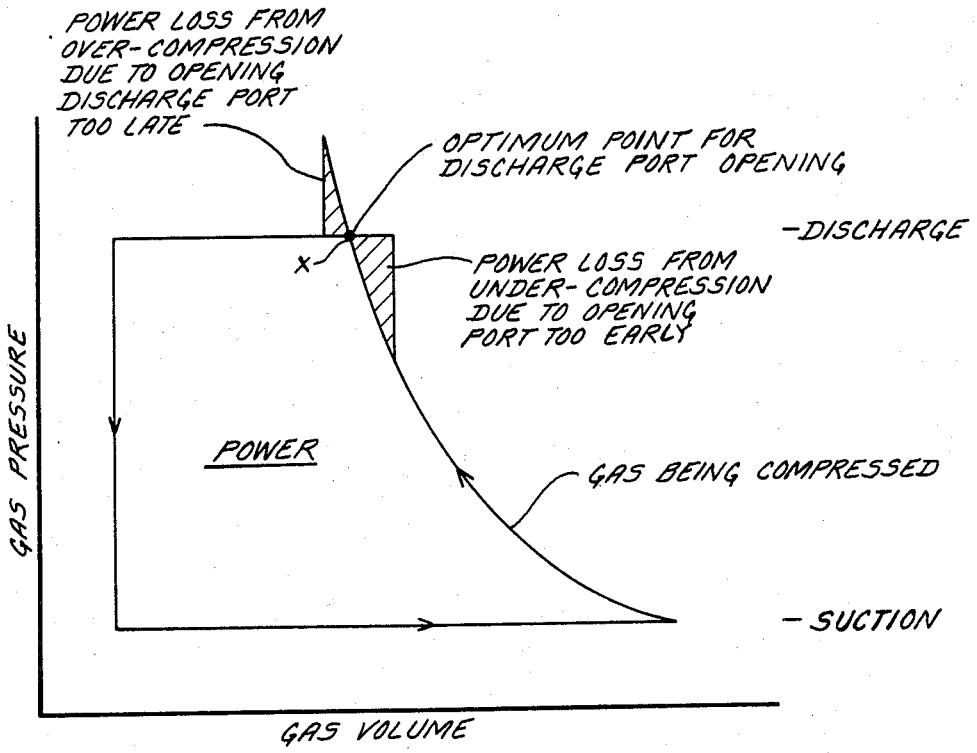
Figure 8:
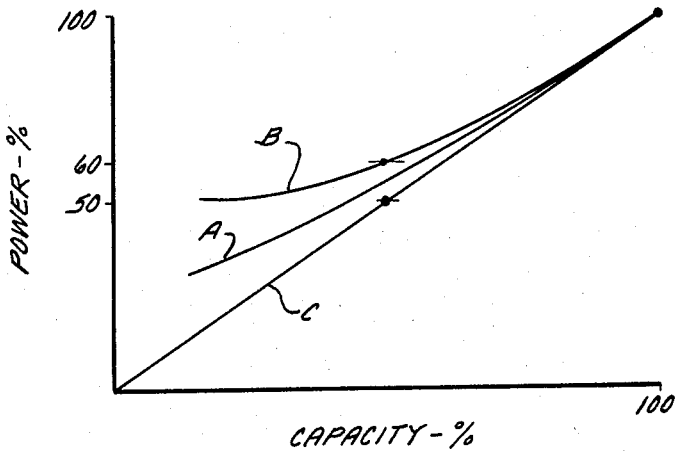

FIG. 5 (which is viewed from the discharge end of the compressor) is an exploded perspective view of one set of slide valves and a portion of the control means therefor;

FIG. 6 is an elevation view, partly in section, taken on line 6—6 of FIG. 2 and showing a set of slide valves and the single screw rotor separated, as by unfolding along line 6—6, to disclose interior details;

FIG. 7 is a top plan view of the compressor shown in FIGS. 1 and 2 and showing a schematic diagram of the control means employed therewith;

FIG. 8 is a graph showing the relationship between compressor power consumption and compressor capacity in a compressor in accordance with the invention; and FIG. 9 is a graph showing a typical pressure-volume diagram for a compressor of the type diclosed herein.

DESCRIPTION OF A PREFERRED EMBODIMENT

Referring to FIGS. 1 and 2, numeral 10 designates a rotary screw gas compressor 10 in accordance with the invention and adapted for use in a refrigeration system (not shown) or the like. Compressor 10 generally comprises a compressor housing 12, a single main rotor 14 mounted for rotation in housing 12 and driven by means of an electric motor M (FIG. 7), a pair of star-shaped gate or star rotors 16 and 18 mounted for rotation in housing 12 and engaged with main rotor 14, and two sets of dual slide valve assemblies 20 and 22 (FIGS. 3 and 7) mounted in housing 12 and cooperable with main rotor 14 to control gas flow into and from the compression chambers on the main rotor 14. FIG. 7 shows a control system responsive to compressor operating conditions to operate the two sets of dual side valve assemblies 20 and 22.

Compressor housing 12 includes a cylindrical bore 24 in which main rotor 14 is rotatably mounted. Bore 24 is open at 27 at the suction end of the bore and is closed by a wall 29 at the discharge end of the bore. Main rotor 14, which is generally cylindrical and has a plurality of helical grooves 25 formed therein defining compression chambers, is provided with a rotor shaft 26 which is rotatably supported at opposite ends on bearing assemblies 28 mounted on housing 12.

Compressor housing 12 includes spaces 30 therein in which the star rotors 16 and 18 are rotatably mounted and the star rotors 16 and 18 are located on opposite sides (180° apart) of main rotor 14. Each star rotor 16 and 18 has a plurality of gear teeth 32 and is provided with a rotor shaft 34 which is rotatably supported at opposite ends on bearing assemblies 34A and 34B (FIG. 2) mounted on housing 12. Each star rotor 16 and 18 rotate on an axis which is perpendicular to and spaced from the axis of rotation of main rotor 14 and its teeth 32 extend through an opening 36 communicating with bore 24. Each tooth 32 of each star rotor 16 and 18 successively engages a groove 25 in main rotor 14 as the latter is rotatably driven by motor M and, in cooperation with the wall of bore 24 and its end wall 29, defines a gas compression chamber.

The two sets of dual slide valve assemblies 20 and 22 are located on opposite sides (180° apart) of main rotor 14 and are arranged so that they are above and below (with respect to FIG. 2) their associated star rotors 16 and 18, respectively. Since the assemblies 20 and 22 are identical to each other, except as to location and the fact that they are mirror images of each other, only assembly 20 is hereinafter described in detail.

Figure 4:
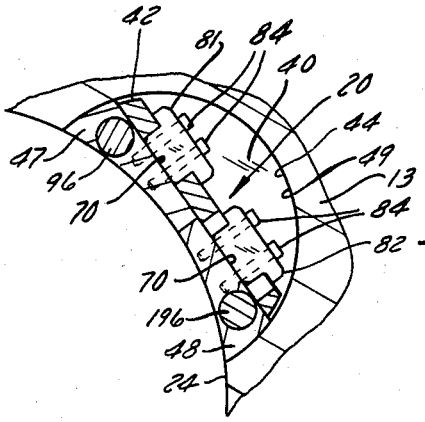
FIG. 4 is an enlarged cross-section view of one set of dual slide valves taken on line 4—4 of FIG. 1 and showing the reciprocating rods of the control means which move the slide valves.

As FIGS. 2, 4, 5 (which is viewed from the discharge end of the compressor), 6 and 7 show, dual slide valve assembly 20 is located in an opening 40 which is formed in a housing wall 13 of housing 12 defining cylindrical bore 24. Opening 40 extends for the length of bore 24 and is open at both ends. As FIG. 5 shows, opening 40 is bounded along one edge by a member 44A (See FIG. 2, also), a smooth surface 44 and has a curved cross-sectional configuration. Opening 40 is further bounded on its inside by two axially spaced apart curved lands 45 and 49. The space between the lands 45 and 49 is a gas inlet passage 70. Opening 40 is provided with chamfered or relieved portion 41 (see FIGS. 5 and 6) at its discharge end which defines a gas port as hereinafter explained. Assembly 20 comprises a slide valve carriage 42 which is rigidly mounted in opening 40 by three mounting screws 46 (see FIG. 5) and further comprises two movable slide valve members, namely, a suction slide valve member 47 (the uppermost member of assembly 20 in FIGS. 2, 4, 5 and 6) and a discharge slide valve member 48, which are slidably mounted on carriage 42 for movement in directions parallel to the axis of main rotor 14.

More specifically, referring to FIG. 5, carriage 42 comprises a rectangular plate portion 52 having a flat smooth front side 53 and having four openings 55, 56, 57 and 58 extending therethrough. Three spaced apart semi-circular projections 60, 61 and 62 extend from the rear side 64 of plate portion 52 of carriage 42. Projection 60 mates with curved surface 44 and with curved land 45 bounding opening 40 and is secured thereto by one mounting screw 46. Projection 61 mates with curved surface 44 and with curved land 49 bounding opening 40 and is secured thereto by the second mounting screw 46. Such mating defines a space which is a continuation of gas inlet passage 70. Projection 62 mates with curved surface 44 bounding opening 40, but projection 62 does not mate with land 49 (although third screw 46 attaches thereto) because chamfered portion 41 provides a gas exhaust passage 66 (see FIG. 7). Thus, the two openings 55 and 56 in carriage 42 are in direct communication with gas inlet passage 70. The other two openings 57 and 58 in carriage 42 are in direct communication with gas exhaust passage 66.

The slide valve members 47 and 48 each take the form of a block having a flat smooth rear surface 70, a curved smooth front surface 72, a flat smooth inside edge 74, a curved smooth outside edge 76, and end edges 78 and 79. End edges 79 are both straight. End edge 78 of suction slide valve member 47 is straight. End edge 78 of the discharge slide valve member 48 is slanted. As FIGS. 2 and 4 show, rear surface 70 confronts and slides upon front side 53 of plate portion 52 of carriage 42. Front surface 72 confronts the cylindrical surface of main rotor 14. The inside edges 74 of the slide valve members 47 and 48 slidably engage each other. The outside edges 76 of the slide valve members confront and slidably engage the curved surfaces 44 adjacent opening 40 in bore 24. The slide valve members 47 and 48 are slidably secured to carriage 42 by clamping members 81 and 82, respectively, which are secured to the slide valve members by screws 84 (see FIGS. 2 and 4). The clamping members 81 and 82 have shank portions 85 and 86, respectively, which extend through the openings 56 and 57, respectively, in carriage 42 and abut the rear surfaces 70 of the slide valve members 47 and 48, respectively. The screws 84 extend through holes 83 (FIG. 2) in the clamping members 81 and 82 and screw into threaded holes 87 in the rear of the slide valve members 47 and 48. The clamping members 81 and 82 have heads or flanges 89 which engage the rear side 64 of plate portion 52 of carriage 42.

Figure 3:
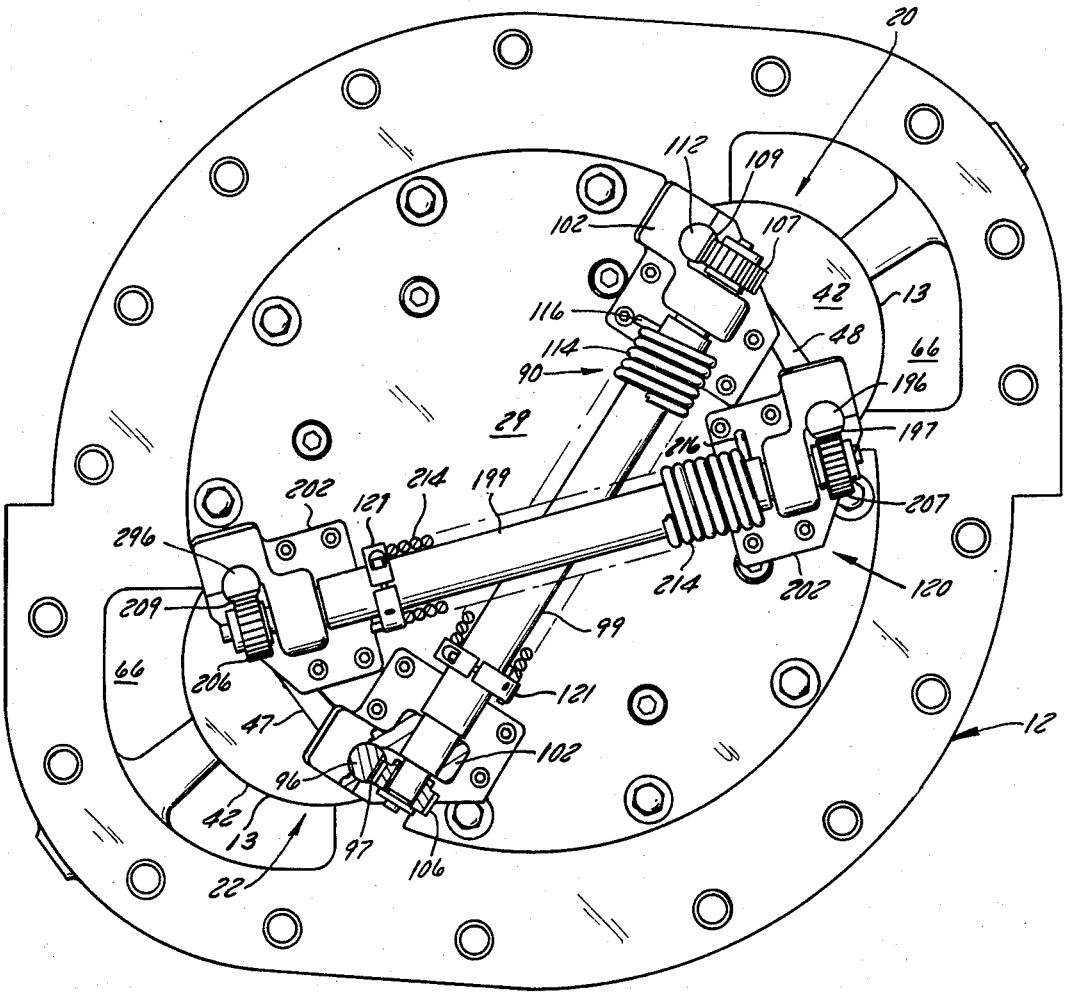
FIG. 3 is an end elevation view taken on line 3—3 of FIG. 1 and showing mechanical connection means between the two sets of dual slide valves.

As FIGS. 3, 5 and 7 show, means, such as a connector assembly 120, is provided to connect together the discharge slide valve members 48 of the two dual slide valve assemblies 20 (right side of FIGS. 3 and 7) and 22 (left side of FIGS. 3 and 7) so that they move in unison with each other when slid to appropriate positions in response to axial movement (extension and retraction) of a control rod 194 which is part of the control system hereinafter described. Thus, referring to FIG. 5, control rod 194 has one end rigidly secured to a piston 134 and its other end to end edge 79 of discharge slide valve member 48. Another rod 196, which has rack teeth 197 along one side thereof, is rigidly secured at one end to the slanted other end edge 78 of discharge slide valve member 48. Referring to FIG. 3, a rotatable rod 199 is rotatably mounted on a pair of rod support brackets 202 which are rigidly secured to support plate 29 which is bolted to the housing 12. Rotatable rod 199 has pinion gears 206 and 207 rigidly secured thereto at its opposite ends. Pinion gear 206 is engaged with the rack teeth 209 on a rod 296 which is connected to the other discharge valve member 48. A helical torsion spring 214 is disposed on rotatable rod 199 and operates to bias both of the discharge slide valve members 48 against the action of control rod 194 to ensure proper positioning of the valve members 48 during extend-retract motions of the control rod. One end of torsion spring 214 is anchored as at 216 to rod support bracket 202. The other end of torsion spring 214 is anchored as by a clamp 121 to rotatable rod 199. Thus, as rod 199 is rotated in one direction by the control rod 194, the torsion spring 214 loads up to exert a bias tending to rotate rod 199 in the opposite direction.

As is apparent, a connector assembly designated 90 and similar to the connector assembly 120 hereinbefore described is provided to connect together the suction slide valve members 47 of the two dual slide valve assemblies 20 and 22 so that discharge slide valve members 47 move in unison with each other when slid to appropriate positions. Referring initially to the left side of FIG. 7, the connector assembly 90 comprises a control rod 94 connected to piston 133 and to suction slide valve member 47 of assembly 22, a rack rod 96 connected to a suction member 47 and having rack teeth 97, a rotatable rod 99 having pinion gears 106 and 107 thereon, a pair of rod support brackets 102, a rod 112 connected to a slide member 47 and having rack teeth 109 thereon, and a tension spring 114. Pinion gear 107 engages rack teeth 109 on the side of slide rod 112 which has one end rigidly secured to the end edge 78 of the suction slide valve member 47 of the slide valve assembly 20.

Referring to FIGS. 5, 6 and 7, the control system for effecting movement of the slide valve members 47 (suction) and 48 (discharge) is seen to comprise two actuators 125 (suction) and 130 (discharge) to operable to effect movement of both of the suction slide valve members 47 and independent movement of both of the discharge slide valve members 48, respectively. The actuators 125 and 130 take the form of hydraulic actuators comprising cylinders 131 and 132, respectively, formed in the compressor housing 12 and containing pistons 133 and 134, respectively, slidably mounted therein. The pistons 133 and 134 are connected on one side thereof to ends of the aforementioned control rods 94 and 194, respectively. The pistons 133 and 134 are connected on the other side thereof to the ends of sensor rods 137 and 138, respectively, which are associated with sensing devices 139 and 140, respectively, which provide electrical signals indicative of the locations of the slide valve members 47 and 48, respectively, and thus reflect or indicate certain compressor conditions, as hereinafter explained. The pistons 133 and 134 move in response to hydraulic fluid (oil) supplied through fluid ports 144 and 145, respectively, from a fluid source 146 through solenoid valves 152 and 153, respectively, or returned to the source 146 through solenoid valves 147 and 148, respectively. The solenoid valves 152, 153 and 147, 148 are controlled by electric output signals from an electronic control 155 which receives electric input signals from a motor controller 156 for motor M and from the sensing devices 139 and 140, as hereinafter explained.

In operation, the two suction slide valve members 47 move in unison with each other, and the two discharge slide valve members 48 move in unison with each other. Each suction slide valve member 47 is slidably positionable (between full load and part load positions) relative to suction port 55 to control where low pressure uncompressed refrigerant gas from gas inlet passage 70 is admitted to the compression chambers or grooves 25 of main rotor 14 to thereby function as a suction by-pass to control compressor capacity. Each discharge slide valve member 48 is slidably positionable (between minimum and adjusted volume ratio positions) relative to discharge port 58 to control where, along the compression chambers or grooves 25, high pressure compressed refrigerant gas is expelled from the compression chambers 25, through discharge port 58 to gas exhaust passage 66 to thereby control the input power to the compressor. The slide valve members 47 and 48 are independently movable by the separate piston-cylinder type hydraulic actuators 125 and 130, respectively. The control means or system is responsive to compressor capacity and to power input, which is related to the location of the slide valves 47 and 48, and operates the actuators to position the slide valve members 47 and 48 to cause the compressor to operate at a predetermined capacity and a predetermined power input. The slide valves 47 are capable of adjusting the capacity between about 100% and about 10%. The slide valves 48 are capable of adjusting the discharge condition so that power required by the compressor to maintain the desired capacity is at a minimum. The control system includes sensing devices 139 and 140 to detect the position of the slide valve members 47 and 48, respectively.

Preferably, as FIG. 7 shows, the sensing devices 139 and 140 each take the form of a commercially available device, such as a linearly variable differential transformer (LVDT), in which a movable core 142, which is axially moved by its respective sensor rod 137 or 138, affects the electrical output signal from a stationary induction coil 144 and thus provides an electrical output signal to controller 155 indicative of the position of the respective slide valves 47 and 48. Although a rheostat (not shown) could be employed instead of an LVDT, the former is subject to wear and break-down because of its frictionally engaging components, whereas the LVDT exhibits little wear and relies on proximity and position of the components 142 and 144 for operation.

The output signals are converted by the controller 155 into electrical control signals which operate the solenoid valves 153 and 152 (and 148 and 147) and thus meter hydraulic fluid flow to operate the actuators 130 and 125, respectively, to properly locate the slide valves 48 and 47 at desired locations. These locations are initially selected by providing manual input signals from a switch panel 150 by the person responsible for compressor operation. Controller 155 includes read-out means 156 to visually indicate the selected and actual operating conditions.

If preferred, instead of electrical or electronic sensors such as 139 and 140, the positions of the slide valves 47 and 48 could be ascertained by detecting pressure conditions at selected points in the compressor 10 by means of suitable pressure sensing devices (not shown) and the signals therefrom could be converted to electrical signals for operating the actuators 125 and 130.

Or, the compressor gases themselves at various points in the system, could be used directly to effect positioning of the slide valves 47 and 48, if suitable structures (not shown) are provided.

Referring to FIG. 6, when the compressor 10 is in its maximum capacity or condition (loaded), the suction slide valve 47 is in the position shown in solid lines relative to main rotor 4, to housing 12, and to the ports 55 and 57.

FIG. 6 also shows that, when the compressor 10 is in its minimum capacity condition (fully unloaded), the slide valve 47 is in the position shown in phantom (dashed) lines relative to each other, to main rotor 14, to housing 12 and to the port 55.

FIG. 6 further shows the minimum volume position for discharge slide valve member 48 in solid lines and its maximum volume position in phantom lines.

As will be understood, the gas pressure at the discharge port of a compressor tends to vary substantially in response to variations in ambient temperatures resulting from seasonal or environmental temperature changes. Referring to the pressure-volume diagram in FIG. 9, if not corrected, the gas may be over-compressed in some situations, as when the discharge port opens late with respect to an optimum opening point X, and this results in over-compression and extra work for the compressor, with resultant undesirable waste of electrical input power needed for operating the compressor because the gas is trapped in the rotor grooves for a longer period of time and its volume is reduced as its pressure is increased i.e., the volume ratio is increased. Conversely, when the discharge port opens early with respect to optimum point X, there is also a power loss because the volume ratio (i.e., the ratio of inlet gas volume to outlet gas volume) is lowered i.e., the internal cylinder pressure at the point of discharge is lowered, thereby causing the compressor volume ratio to decrease. The two discharge slide valves 48 in accordance with the invention are movably positionable to adjust the location at which the discharge ports 58 open; the preferred location being that point X in FIG. 9 at which internal gas pressure in the compression chambers on the rotor equals the condensing pressure in the refrigeration system in which the compressor is employed.

The line A in the graph in FIG. 8 shows the relationship between compressor capacity (expressed in percentage) and compressor power (expressed in percentage) which is achieved by the slide valve members 47 and 48 and the control means therefor in accordance with the present invention, as compared to the line B which shows a typical relationship found in prior art compressors. Line C shows the theoretical optimum relationship.

Means are provided in the present invention to determine the positions for the slide valves 47 and 48 which would provide the most efficient volume ratio. These means could, for example, take the form of a microprocesser circuit (not shown) in the controller which mathematically calculates these slide valve positions, or these means could take the form of pressure sensing devices, such as are disclosed in the preferred embodiment herein. As disclosed herein means are employed to sense these two (inlet and outlet) pressure conditions and to shift the slide valve 48 axially in the proper direction for the proper distance until the equalization location (point X in FIG. 9) is reached. The present invention enables equalization to be accomplished at part-load, as well as full-load, conditions because of the independently movable dual slide valves 47 and 48.

It should also be noted that in the preferred embodiment disclosed herein the two valve members 47 (on opposite sides of the rotor) are moved in synchronism with each other and the two valve members 48 (on opposite sides of the rotor) are moved in synchronism with each other so as to provide for "symmetric" unloading of the compressor. However, each slide valve member in a pair can be moved independently of the other so as to provide for "asymmetrical" unloading of the compressor, if appropriate linkages (not shown) are provided and if the control system is modified accordingly in a suitable manner.

When the compressor operates at low capacity, inefficiency results and power losses increase substantially. Half of such inefficiency would be attributable to losses on one side of the rotor. Therefore, the advantages of such independent valve member movement as above-described is that, when the compressor is unloaded to a point where, for example, about 50% of total compressor capacity is reached, it would then be possible to effectively "shut off" one side of the compressor and eliminate all losses associated with the "shut off" side of the compressor. Although this might result in some radial load imbalance on the rotor, this could be acceptable under some circumstances, or provisions could be made to compensate for such imbalance.

It should be further noted that, when the suction slide valve member 47 is moved to its completely unloaded position (phantom view in FIG. 6), no gas is trapped in the compression chambers. Under these circumstances, the location of the associated discharge slide valve member 48 is of no immediate concern as regards gas flow but it might be preferable to move it to the theoretical minimum volume ratio position in order to facilitate construction and operation of the control system.

I claim:

1. A rotary screw gas compressor for a refrigeration system comprising:

a compressor housing comprising end walls at opposite ends thereof and a rotor bore therein;

a motor-driven main rotor having helical grooves and mounted for rotation in said rotor bore;

a pair of star-shaped gate rotors rotatably mounted in said housing and engageable with said helical grooves in said main rotor to define a plurality of gas compression chambers;

suction port means and discharge port means in said compressor housing;

a pair of recesses in said housing disposed on opposite sides of said main rotor and communicating with said rotor bore;

a pair of suction slide valve members and a pair of discharge slide valve members, with one suction slide valve member and one discharge slide valve member being located in one of said recesses on one side of said main rotor and the other suction slide valve member and the other discharge slide valve member being located in the other of said recesses on another side of said main rotor;

a first linkage mounted on the exterior of one end wall of said housing for interconnecting the two suction slide valve members to enable them to move in unison;

a second linkage mounted on the exterior of said one end wall of said housing for interconnecting the two discharge slide valve members to enable them to move in unison;

each linkage comprising a pair of rods extending through said one end wall and connected to respective slide valves whereby movement of one slide valve in a pair effects movement of the corresponding slide valve in the other pair;

both slide valve members in each of said recesses being disposed in side-by-side sliding relationship in their respective recess, and each slide valve member having a face which is complementary to and confronts said main rotor surface in sliding sealed relationship;

said suction slide valve members being slidably positionable between full-load and unload positions to control where low pressure uncompressed refrigerant gas from said suction port means is admitted to said compression chambers to thereby function as a suction bypass to control compressor capacity;

said discharge slide valve members being slidably positionable between minimum and adjusted volume ratio positions to control where high pressure compressed refrigerant gas is expelled from said compression chambers to said discharge port means to thereby control the input power to the compressor;

a first actuator assembly on said housing for moving said pair of suction slide valves in unison with each other; a second actuator assembly on said housing for moving said pair of discharge slide valves in unison with each other;

each actuator assembly comprising:

an actuator mounted on said housing and including a movable actuator member;

a first rod extending inwardly from the other end wall of said compressor housing for mechanically connecting said movable actuator member to one slide valve in one of a pair of slide valves;

a second rod extending outwardly from said other end wall and connected to said movable actuator member;

and control means responsive to compressor capacity and volume ratio to position said slide valve members to cause the compressor to operate at a predetermined capacity and minimum power input, said control means including a pair of sensing devices mounted on said housing to detect the position of said slide valve members and to effect operation of said actuators, each of said sensing devices being connected to said second rod of said respective actuator member to thereby detect the position of its associated pair of slide valve members.

2. A rotary gas compressor according to claim 1 wherein said control means is responsive to the capacity of said compressor to move the suction slide valve members to said unload position when compressor capacity falls below a predetermined value.

3. A rotary gas compressor according to claim 1 wherein said first and second sensing devices are responsive to the position of an associated slide valve member to provide an electrical signal indicative of said position.

4. A rotary gas compressor according to claim 3 wherein each actuator comprises a hydraulic cylinder, wherein said control means comprises solenoid valves for controlling fluid flow to and from said hydraulic cylinder and wherein said sensing means operates said solenoid valves.

5. A rotary gas compressor according to claim 1 wherein each sensing device comprises a linearly variable differential transformer.

6. A rotary gas compressor according to claim 1 or 5 wherein said pair of rods in said each linkage have rack teeth thereon, and wherein each linkage further comprises a rotatable member mounted for rotation on said other end wall of said housing, and pinion gears on said rotatable member engaged with said rack teeth.

7. A rotary gas compressor according to claim 6 wherein said actuators are hydraulic actuators.

* * * * *